US008336932B2

(12) United States Patent
Roussel et al.

(10) Patent No.: US 8,336,932 B2
(45) Date of Patent: Dec. 25, 2012

(54) CLOSURE SYSTEM FOR A DOOR OPENING

(75) Inventors: Jerome Roussel, Colmar (FR); Michel Noel, Anould (FR)

(73) Assignee: Inteva Products France SAS (FR)

( * ) Notice: Subject to any disclaimer, the term of this patent is extended or adjusted under 35 U.S.C. 154(b) by 938 days.

(21) Appl. No.: 11/861,629

(22) Filed: Sep. 26, 2007

(65) Prior Publication Data

US 2008/0073934 A1 Mar. 27, 2008

(30) Foreign Application Priority Data

Sep. 26, 2006 (FR) ..... 06 08420

(51) Int. Cl.
*E05B 15/02* (2006.01)
*E05C 19/00* (2006.01)

(52) U.S. Cl. ..... 292/340; 292/341.12; 292/DIG. 53; 292/DIG. 54; 292/DIG. 64

(58) Field of Classification Search ..... 292/146.9, 292/DIG. 53, DIG. 54, DIG. 641, 340, 341, 292/341.11, 341.12, 341.18, 341.13, 341.19
See application file for complete search history.

(56) References Cited

U.S. PATENT DOCUMENTS

| | | | | | |
|---|---|---|---|---|---|
| 4,165,112 | A * | 8/1979 | Kleefeldt | 292/216 |
| 5,494,324 | A * | 2/1996 | Kleefeldt | 292/340 |
| 6,042,160 | A * | 3/2000 | Hamada et al. | 292/216 |
| 6,059,328 | A * | 5/2000 | Gomi | 292/216 |
| 6,155,618 | A * | 12/2000 | Ichinose | 292/340 |
| 6,631,933 | B1 * | 10/2003 | Westerwick | 292/340 |
| 6,994,395 | B2 * | 2/2006 | Cathala | 296/193.04 |
| 7,025,395 | B2 * | 4/2006 | Fisher | 292/340 |
| 2006/0087126 | A1 * | 4/2006 | Roussel | 292/116 |

FOREIGN PATENT DOCUMENTS

| | | |
|---|---|---|
| DE | 19840464 | 3/2000 |
| WO | 02/088496 | 11/2002 |

OTHER PUBLICATIONS

French Search Report dated May 21, 2007.

* cited by examiner

*Primary Examiner* — Carlos Lugo
*Assistant Examiner* — Alyson M Merlino
(74) *Attorney, Agent, or Firm* — Cantor Colburn LLP

(57) ABSTRACT

A closure system for a door opening includes a striker having a support plate and a striker wire, and a lock having a bolt actuated by a detent pawl and adapted to retain the striker wire in the door opening. The lock and the striker each have at least one attachment feature that is complementary and separate from the bolt and the striker wire. The striker is thus secured to the lock during the installation of the closure system on the vehicle.

19 Claims, 5 Drawing Sheets

CLOSURE SYSTEM FOR A DOOR OPENING

REFERENCE TO RELATED APPLICATIONS

This application claims priority to French Patent Application No. FR 06 08 420 filed on Sep. 26, 2006.

BACKGROUND OF THE INVENTION

The present invention relates to a closure system for a door opening including a striker and a lock.

A lock makes it possible to maintain a door opening for an automotive vehicle in a closed position. A lock also makes it possible to unlock the door opening by operating an internal or external opening control device connected to the lock, which may be actuated by a user. Such a lock is typically mounted on the door opening of the vehicle.

A striker makes it possible to maintain the lock in the closed position on the door opening. The striker typically includes a plate fixed to bodywork of the vehicle and a striker wire or striker bolt consisting of a steel wire formed with a pin perpendicular to the striker plate.

The lock typically has a bolt, the function of which is to fix the striker wire mounted on the vehicle relative to the lock or, conversely, to release the striker wire. The operation of releasing the striker wire is known as opening the lock, which makes it possible to unlock the door opening. On the other hand, retaining the striker wire in the lock is known as closing the lock, which prevents unlocking of the door opening.

The bolt is urged into the closed position by the striker wire during closure of the door opening, and a detent pawl prevents the return of the bolt towards an open position and guarantees that the lock is maintained in the closed position in the absence of external action on the lock. The detent pawl is actuated by an opening control device, typically a door handle, in order to release the bolt and to allow the disengagement of the striker wire. Depending on the types of lock, the detent pawl may be actuated via an opening lever actuated by an opening control device or the detent pawl itself which has a hook forming a lever. Generally, when the door is slammed shut, the lock passes from an open state to a fully closed state. When the opening control device is actuated, the lock passes from the fully closed state to the open state.

Conventionally, a vehicle is defined with respect to three directions: an X direction of travel of the vehicle, a vertical Z direction from the ground to the sky and a lateral Y direction perpendicular to the X and Z directions, forming a direct trihedron.

A closure system conventionally includes stops to limit overtravel of the lock when the door is slammed shut and to lock the door in position when the vehicle is traveling. In particular, during traveling, the door tends to be displaced in the Z direction relative to the bodywork. When the door is slammed shut, the door tends to be pushed in beyond the closed position, in the Y direction, or in the X direction in the case of a rear door.

In the case of a utility vehicle equipped with a large swinging door or a sliding door, a pair of closure systems is used. A closure system is fixed in an upper part (the striker on a roof of the vehicle and the lock in the upper part of the door), and a closure system is fixed in the lower part (the striker on a floor of the vehicle and the lock in a lower part of the door). Such a lock arrangement is, for example, known in the utility vehicle of the Renault company marketed under the trade name Trafic®. It is understood that the expressions "upper part" and "lower part" refer to the Z axis as defined above relative to the vehicle.

FIGS. 1 and 2 show the closure system installed, in particular, in the upper part on a rear swinging door of a Renault Trafic® utility vehicle. The closure system includes a striker 10 and a lock 20, the striker 10 being intended to be fixed to a roof of a vehicle, and the lock 20 being intended to be fixed at a top of one of the door leaves.

The striker 10 and the lock 20 are generally delivered together by the supplier to the manufacturer, with the striker wire being retained by a bolt of the lock 20. Typically, the installation of the closure system by an operator is carried out by firstly pre-fixing the lock 20 to the door, then by connecting a cable for actuating the opening between a lever 21 of the lock 20 and a handle of the door of the vehicle. The door is then closed, and the striker 10 is fixed to bodywork of the vehicle. Then, the fixing of the lock 20 is adjusted on the door in the definitive position. Oblong holes 22 in a retaining plate of the lock 20 allow, namely, a pre-positioning of the lock 20 on the door with play in the Z direction. Similarly, the striker 10 has oblong holes 12 which allow an adjustment of the positioning of the striker 10 on the bodywork in the X direction or Y direction.

The striker 10 is thus fixed to the bodywork of the vehicle when the lock 20 is in the closed position in order to guarantee a relatively accurate positioning of the closure elements and, in particular, of the striker wire relative to the movement of the bolt. The oblong holes 12 and 22 of the striker 10 and the lock 20 make it possible to ensure this relative positioning during the fixing of the closure elements on the door and the bodywork of the vehicle. The striker 10 thus remains coupled to the lock 20 during the steps of installing the lock 20 on the door and, in particular, during the step of fixing the cable for actuating the opening between the lever 21 of the lock 20 and the door handle. During the operation of installing the cable for actuating the opening, the tension of the cable may lead to the actuation of the bolt of the lock 20 and the release of the striker wire. When the closure system is installed in the upper part, the release of the striker wire causes the striker 10 to fall, which may injure the operator and/or damage the striker or the bodywork of the vehicle (the floor).

To mitigate against this problem on the Renault Trafic® vehicle, it has been proposed to provide the closure system with a retaining clip 30 which prevents any movement of the bolt of the lock 20 in spite of a possible actuation of the opening lever during the fixing of the cable for actuating the opening. The striker 10 is thus prevented from falling because the striker wire remains secured by the bolt of the lock 20.

The retaining clip 30, produced in molded plastic, has numerous drawbacks. First, it increases the cost of the closure system, including the cost of the plastic part itself and the cost of the assembly of the striker 10 and the lock 20 (the assembly is carried out by pressing). The retaining clip 30 also provides an additional cost when installing the closure system on the vehicle. An additional operation is required by the operator, who has to remove the retaining clip 30 after installation. Moreover, the retaining clip 30, which is assembled in a press, is difficult to remove in spite of a grip 31. Moreover, the retaining clip 30 is discarded after use and is an additional waste component that is to be handled.

There is, therefore, a need for an improved and less costly closure system which makes it possible to secure the striker 10 and the lock 20 together during the installation of the closure system in the upper part, in particular during the step of fixing a cable for actuating the opening between the lever of the lock 20 and the door handle.

Furthermore, the fixing of the closure system in the lower part causes a further problem. FIGS. 3 and 4 show a closure system to be fixed in the lower part of the door, with the striker 10 coupled to the lock 20. A striker wire 11 is secured by a bolt 24. As described above, the installation of the closure system by an operator is carried out by first pre-fixing the lock 20 on the door, then by connecting a cable 40 for actuating the opening between the lever 21 of the lock 20 and a handle of the vehicle door. The door is then closed, and the striker 10 is fixed to the bodywork of the vehicle. In the lower part, the striker 10 is intended to be fixed to a floor 100 of the vehicle. When the door is closed with the lock 20 pre-fixed on the door, a striker support plate 15 may scrape or strike against the floor 100 (zone A encircled in FIG. 3), which may damage the paintwork, the anti-corrosion treatment of the bodywork, the striker 10 or other elements, and/or force the operator to hold the striker 10 manually to lift it to allow the closure of the door.

More specifically, as illustrated in FIG. 4, the lock 20 is pre-fixed to the door by screws 23 inserted into the oblong holes 22 of a retaining plate 25 of the lock 20. As explained above, the oblong holes 22 are necessary for allowing the adjustment of the position relative to the striker 10 and the lock 20 in the Z direction. However, due to gravity, the pre-fixed lock 20 retracts with the screws 23 in an upper abutment into the oblong holes 22, and this retraction may bring the striker support plate 15 below the level of the floor 100 of the vehicle. Moreover, the striker support plate 15 tends to pivot downwards due to its own weight. Thus, when the door is slammed shut to fix the striker 10 to the floor 100 and complete the fixing of the lock 20 on the door, the striker support plate 15 may abut against the bodywork of the vehicle and be damaged or damage the bodywork of the vehicle.

The retraction $\Delta s$ of the lock 20 in the Z direction relative to its required final position is, at a maximum, equal to a length of the oblong hole 22 less a width of the oblong hole 22, i.e., substantially equal to the length of the oblong hole 22 less a diameter of the screw 23, i.e., approximately 5 to 6 mm. The retraction is, however, sufficient to hamper the closure of the door in order to proceed with the fixing of the striker 10 to the floor 100 of the vehicle.

There is, therefore, also a need for a closure system which makes it possible to avoid the impact of the striker against the bodywork of the vehicle during the installation of the closure system in the lower part.

SUMMARY OF THE INVENTION

To this end, the present invention provides a closure system for a vehicle door opening including a striker having a striker support plate and a striker wire, and a lock having a bolt actuated by a detent pawl and adapted to retain the striker wire. The lock and the striker each have at least one attachment feature that is complementary and separate from the bolt and the striker wire.

According to one embodiment, a first attachment feature is a pin, and a second attachment feature is a recess adapted to retain the pin. According to another embodiment, the complementary attachment features cooperate, in the absence of fixing the striker to the vehicle.

According to one embodiment, the complementary attachment features cooperate regardless of the position of the detent pawl of the lock.

According to one embodiment, the lock includes a housing provided with an opening adapted to receive the striker wire, with the opening of the lock housing including a delta-shaped portion, and the attachment feature of the lock is located on the delta-shaped portion of the lock housing.

According to one embodiment, the striker further has a stop in abutment in the opening of a lock housing when the striker wire is retained by the bolt, and the stop extends over a portion of the striker support plate. According to one embodiment, the attachment feature of the striker is formed in the stop.

According to one embodiment, the lock includes a retaining plate, and the striker support plate forms a non-zero angle of inclination with a plane perpendicular to the plane of the retaining plate and containing the striker wire when the complementary attachment features cooperate.

According to one embodiment, the retaining plate of the lock has at least one oblong fixing hole, and an angle of inclination of the striker support plate is $L \cdot \sin(\beta) \geqq \Delta s$, with L being a length of the striker support plate perpendicular to the retaining plate of the lock and As being a length of the oblong hole less a width of the oblong hole.

The invention also relates to a striker for closing a door opening including a striker support plate, a striker wire, and at least one attachment feature formed on the striker support plate and located in a plane containing the striker wire.

According to one embodiment, the striker further includes an overmolding surrounding a portion of the striker wire and extending over a portion of the striker support plate. According to one embodiment, the attachment feature is formed in the overmolding.

The invention also relates to a lock for closing a door opening including a retaining plate, a housing having an opening with at least one delta shaped portion, and at least one attachment feature formed in the delta-shaped portion.

According to one embodiment, the retaining plate has at least one oblong fixing hole, and the delta-shaped portion of the opening of the lock housing is at an angle with a center opening plane, perpendicular to the plane of the retaining plate. The cosine of the angle of the delta-shaped portion is greater than or equal to the length of the oblong hole less the width of the oblong fixing hole.

The invention further proposes a method for installing a closure system for a door opening on a vehicle. The method includes the step of receiving a closure system having a lock with a bolt and a striker with a striker wire, the lock and the striker being attached by at least the cooperation of complementary attachment features which are separate from the bolt and the striker wire. The method further includes the steps of vertical pre-fixing of the lock on the door opening of the vehicle in the open position, closing the door opening with the pre-fixed lock and fixing the striker to the vehicle to cause the detachment of the complementary attachment features.

According to one embodiment of the installation method, the closure system is the closure system described above.

BRIEF DESCRIPTION OF THE DRAWINGS

Further features and advantages of the invention will appear by reading the detailed description which follows the embodiments of the invention, given solely by way of example and by referring to the drawings, in which.

DETAILED DESCRIPTION OF THE PREFERRED EMBODIMENT

Figure 5:
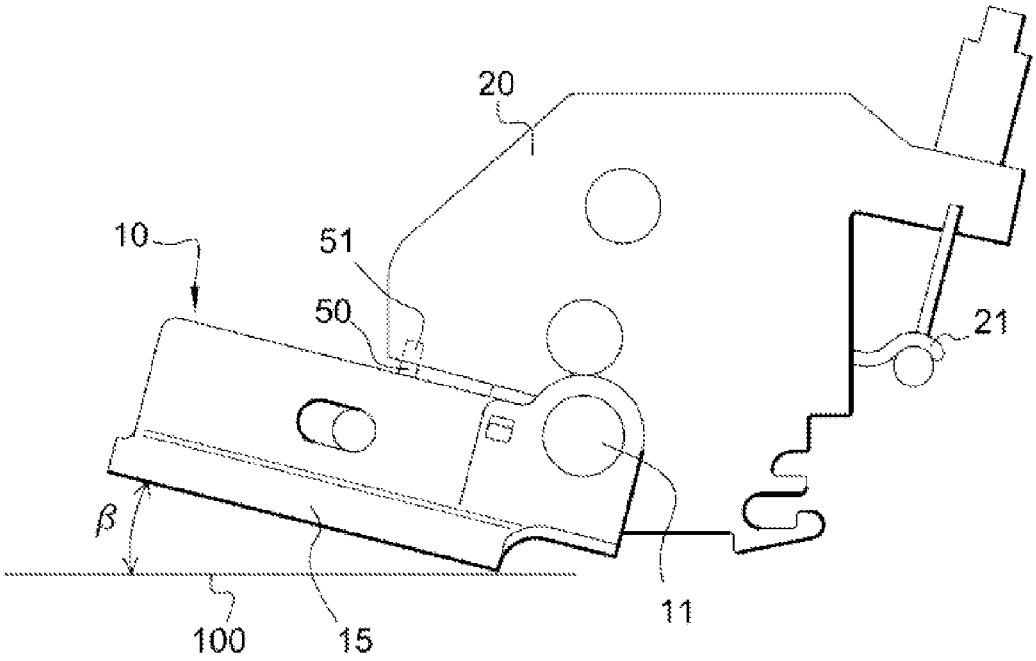
FIG. 5 shows a schematic side view of a closure system according to the invention.

The closure system according to the invention will be described in detail with reference to FIG. 5. The invention proposes a closure system for a door opening including a striker 10 and a lock 20. The elements which are identical to those described above bear the same reference numerals. Thus, the striker 10 has a striker support plate 15 and a striker wire 11. In FIG. 5, the striker wire 11 is retained by a bolt 24 in an opening of a housing of the lock 20. The lock 20 is said to be in the closed position.

According to the invention, the striker 10 and the lock 20 each have at least one attachment feature, the attachment features 50 and 51 being complementary to one another. The complementary attachment features 50 and 51 are separate from the bolt 24 and the striker wire 11, and at least one of the attachment features 50 and 51 is adapted to retain the other attachment feature 50 and 51. In the illustrated examples, a pin 50 and a recess 51 adapted to retain the pin 50 have been used as the attachment features. FIG. 5 illustrates the pin 50 projecting from the striker 10 and a recess 51 made in a housing of the lock 20. Naturally, other specific attachment features are conceivable.

A closure system has thus been obtained in which the striker 10 may remain secured to the lock 20 in spite of actuating a detent pawl 28 by an opening control device which tends to release the bolt 24. In particular, when the closure system is intended to be placed in an upper portion of a vehicle door opening, the striker 10 remains fixed to the lock 20 during the entire installation time. A possible actuation of the detent pawl 28 during the positioning of an actuating cable between a lever 21 of the lock 20 and a handle of the door opening will not cause the striker 10 to fall as described above because the striker 10 remains secured to the lock 20 by the pin 50 retained in the recess 51.

The closure system according to the invention may thus be delivered to the vehicle manufacturer with the striker 10 and the lock 20 assembled in order to limit the number of parts delivered and to simplify the operations for installation on the vehicle. In particular, the striker 10 and the lock 20 of the closure system according to the invention remain attached, as long as the striker 10 has not been fixed to the bodywork of the vehicle. Thus, during the entire time of transportation, storage and pre-fixing of the lock 20 on the door opening, the striker 10 remains coupled to the lock 20 by at least the cooperation of the complementary attachment features, namely by the pin 50 retained in the recess 51 in the illustrated example.

According to one embodiment, the pin 50 may be made of plastic. It may have a quadrant-shaped or star-shaped stud or have any other appropriate shape to guarantee both easy insertion and good retention in the recess 51. The material constituting the pin 50, in addition to its shape and size, are selected to make it possible both to retain the pin 50 in the recess 51 in spite of the weight of the striker 10 and to withdraw the pin 50 from the recess 51 with a limited force. For example, the pin 50 is inserted in the recess 51 with a maximum force of 9 daN, and the pin 50 does not become detached from the recess 51 as long as the force applied to the pin 50 is less than or equal to 3 daN. These values have been determined by the applicant from vibration tests carried out on closure systems. The removal of the pin 50 from the recess 51 is thus carried out with a withdrawal force of greater than 3 daN, which makes it possible to avoid the falling of the striker 10 under the force of its own weight and guarantees that the lock striker assembly does not become detached during transportation, or under the effect of specific impacts.

It is desired to position the pin 50 and the recess 51 such that when the pin 50 is retained in the recess 51, the striker wire 11 is located in the opening of the lock 20 as in the fully closed position of the lock 20, even if the detent pawl 28 has been actuated to release the striker wire 11 by inadvertent handling by the operator of the assembly. The striker 10 is thus retained in a relative position with regard to the lock 20, which corresponds to that which it will need to have once the fixing of the closure system is complete.

According to one embodiment, the opening of the lock housing that is adapted to receive the striker wire 11 has a delta-shaped portion. The shape is conventional on lock housings for vehicle door openings, as the delta shape constitutes a guide or gulley for the striker wire 11 when the door is slammed shut. When the lock housing is provided with an opening having this shape to receive the striker wire 11, the attachment feature (the pin 50, the recess 51 or the like) of the lock 20 may be located on the delta-shaped portion.

According to the particular embodiment illustrated in FIG. 5, the recess 51 is located in the delta-shaped portion of the lock housing, and the pin 50 is located on a step of the striker support plate 15. Thus, when the pin 50 and the recess 51 cooperate, i.e., when the pin 50 is retained in the recess 51, the striker support plate 15 forms a non-zero angle of inclination $\beta$ with a plane 100 perpendicular to the plane of the retaining plate 25 of the lock 20 and containing the striker wire 11.

Figure 1:
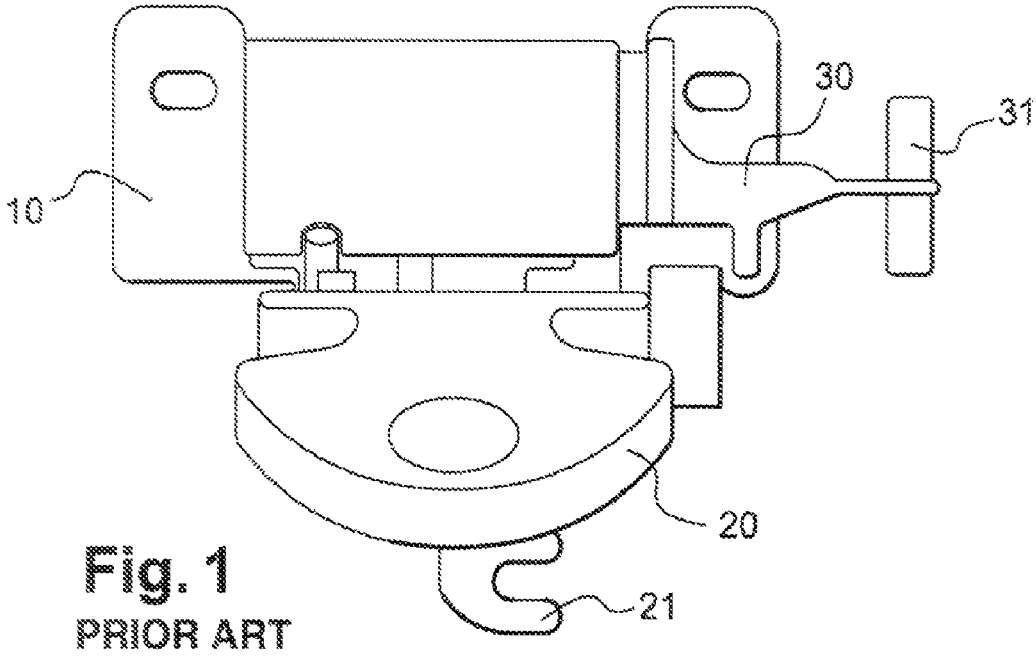
Fig. 1 PRIOR ART
FIG. 1, already described, shows a closure system according to the prior art.
Figure 2:
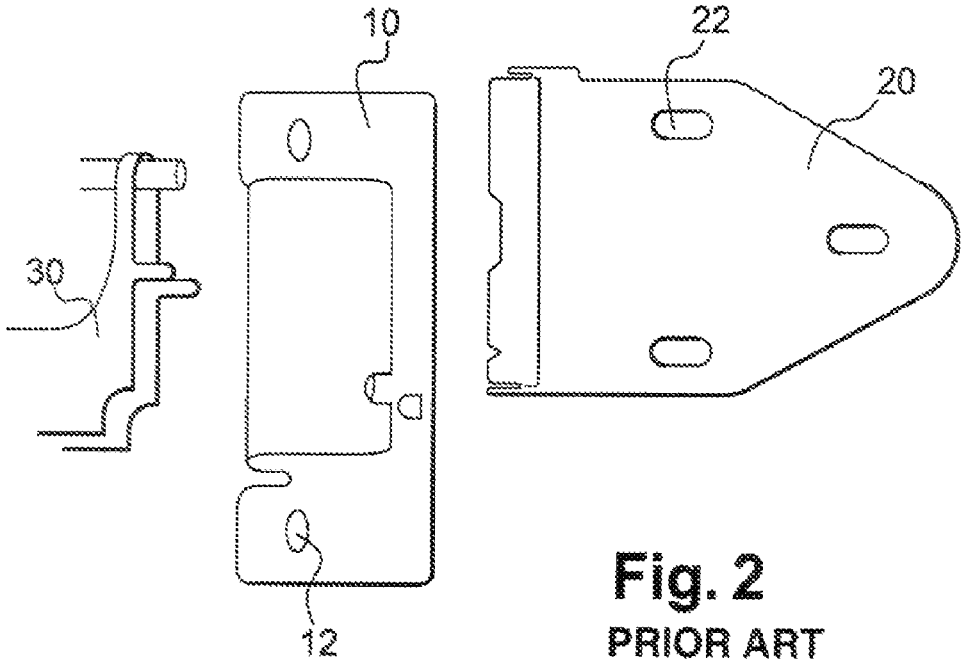
Fig. 2 PRIOR ART
FIG. 2, already described, shows an exploded view of the elements of the closure system of FIG. 1.
Figure 3:
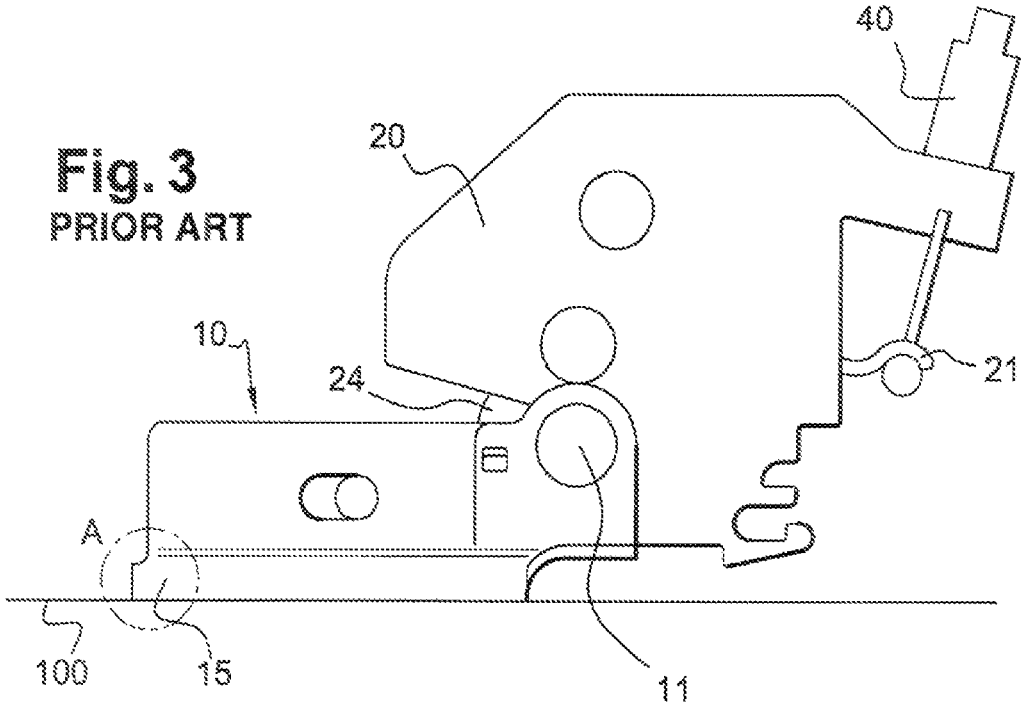
Fig. 3 PRIOR ART
FIG. 3 shows a schematic side view of a prior art closure system to be fixed in a lower part of a vehicle door opening.
Figure 4:
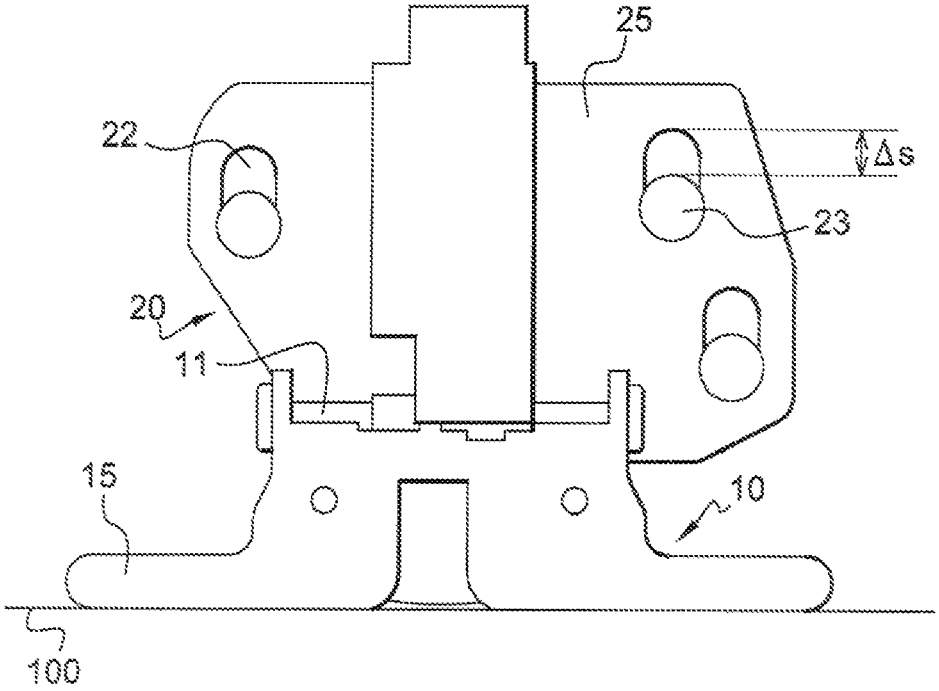
Fig. 4 PRIOR ART
FIG. 4 shows a schematic front view of the closure system of FIG. 3.
Figure 7:
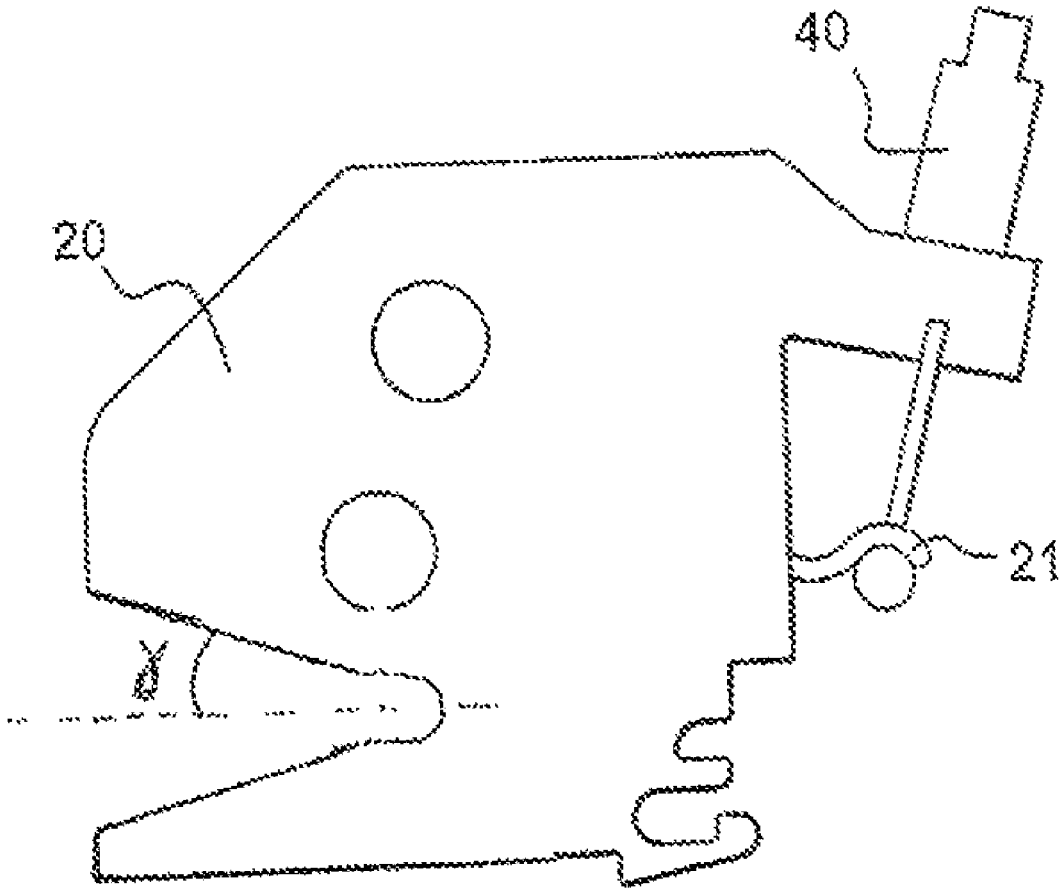
FIG. 7 shows a schematic side view of the lock.
Figure 8:
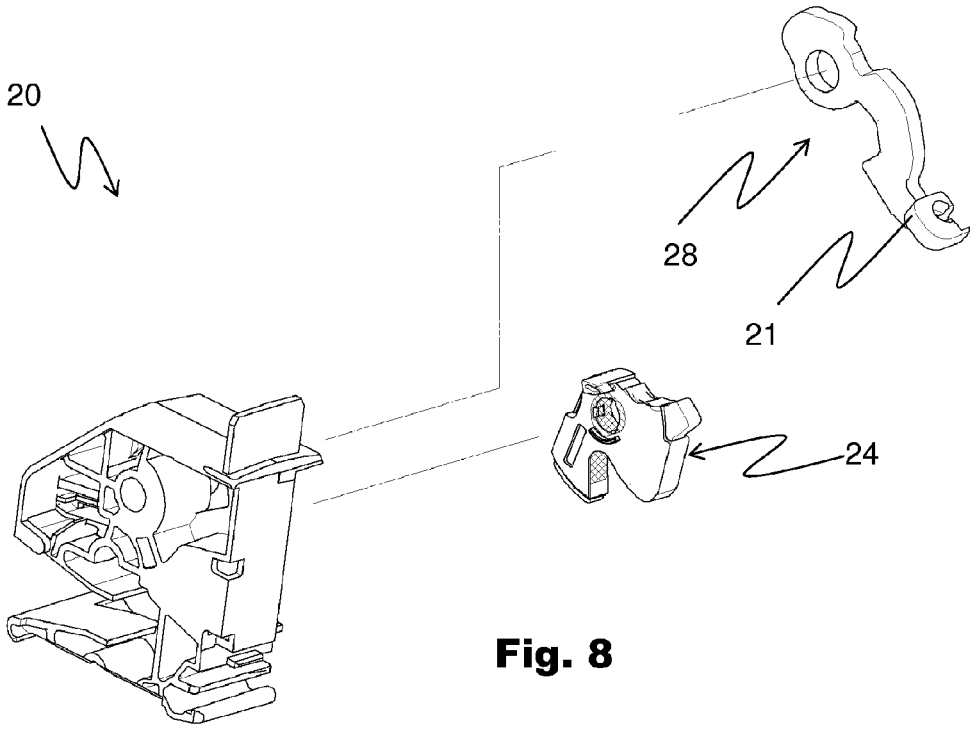
FIG. 8 shows an exploded view of the lock.

If the lock 20 is considered independently of the striker 10 with which it has to cooperate, the lock 20 of the invention includes, amongst others, a retaining plate 25 (shown in FIG. 4), a bolt 24 actuated by a detent pawl 28, a housing with a delta-shaped opening for receiving a striker wire 11 and at least one attachment feature formed in the delta-shaped portion. As shown in FIG. 7, the delta-shaped portion of the opening of the housing lock has an angle $\gamma$ with a center opening plane perpendicular to the plane of the retaining plate 25. The angle $\gamma$ causes the inclination of the striker support plate 15 by an angle $\beta$ as defined above when the complementary attachment features cooperate. The angle $\gamma$ of the at least one delta-shaped portion is such that $D \cdot \sin(\gamma) \geqq \Delta s$, wherein D is a length of the at least one delta-shaped portion and $\Delta s$ is a length of the at least one oblong fixing hole 22 less a width of the at least one oblong fixing hole 22.

Similarly, if the striker 10 is considered independently of the lock 20 with which it has to cooperate, the striker 10 according to the invention includes a striker support plate 15, a striker wire 11 and at least one attachment feature formed on the striker support plate 15 in a plane containing the striker wire 11.

Thus, as illustrated in the example of FIG. 5, when the closure system is intended to be placed in the lower portion of a vehicle door opening, the striker support plate 15 forms an angle $\beta$ with the floor 100 of the vehicle when the lock 20 is pre-fixed in the Z direction on the door opening due to the pin 50 being retained in the recess 51. In order that the inclination is sufficient to avoid an impact of the striker 10 on the floor 100 of the vehicle when the door is closed for fixing the striker 10 in the Y direction, respective positions of the complementary attachment features 50 and 51 will be selected, such that the angle of inclination of the plate meets the following restriction:

$$L \cdot \sin(\beta) \geqq \Delta s,$$

where L is a length of the striker support plate 15 perpendicular to the retaining plate 25 of the lock 20, and $\Delta s$ is a length of the oblong hole 22 less a width of the oblong hole 22 of the retaining plate 25 of the lock 20.

Thus, even if the lock 20, which is pre-fixed in the Z direction on the door opening by screws 23 in the oblong holes 22 (see FIG. 4), retracts under the effect of its own weight, the inclination of the striker support plate 15 will make it possible to approach the floor 100 of the vehicle without collision when slamming the door shut to fix the striker 10.

Figure 6:
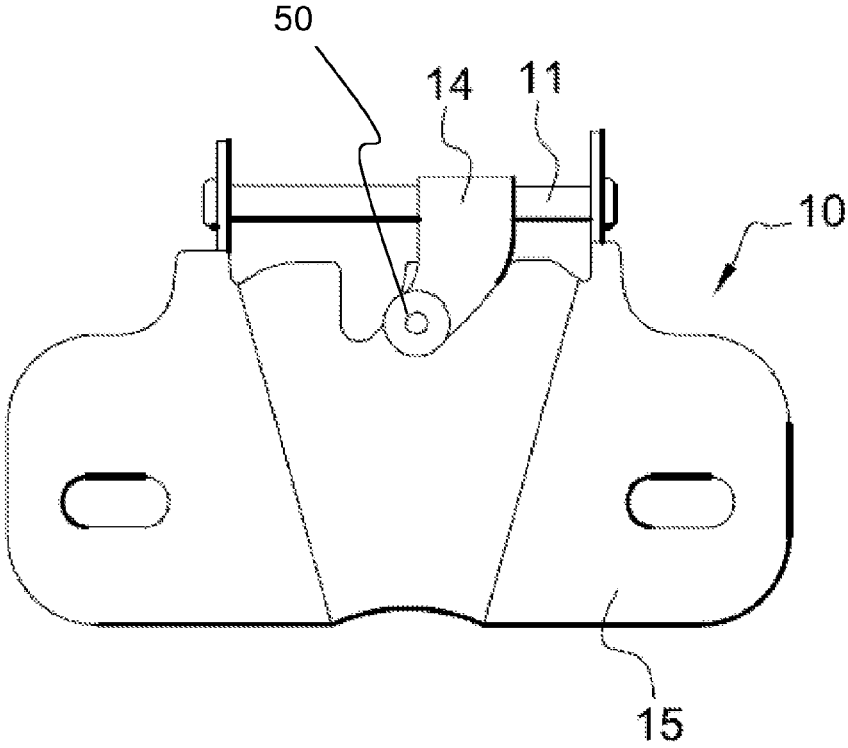
FIG. 6 shows a schematic top view of a striker of the closure system of FIG. 5.

Moreover, as illustrated in FIG. 6, the striker 10 may have a damping device 14 which surrounds a portion of the striker wire 11 to form a stop in the Z direction to dampen the relative displacements of the striker 10 relative to the lock 20 when the vehicle is traveling. The damping device 14 may, moreover, extend over a portion of the striker support plate 15. The pin 50 or the recess 51 of the striker 10 may be formed in the damping device 14 to avoid an increased manufacturing cost.

The damping device 14 may be formed from a simple plastic part, overmolded or fixed by bonding or clipping onto the striker 10 to form a stop in the Z direction. The pin 50 or the recess 51 may thus be formed in the stop part.

The closure system of the door opening according to the invention may be fixed to a vehicle in the following manner.

An assembly including a lock 20 and a striker 10 attached by at least the cooperation of complementary attachment features (a pin 50 retained in a recess 51) is received at the manufacturers.

The lock 20 is pre-fixed, retaining play in the Z direction (vertically) on the door opening of the vehicle, with the door opening open. The striker 10 remains attached to the lock 20. If the lock 20 is pre-fixed in the upper portion of the door opening, the striker 10 does not risk falling, even if the detent pawl 28 is actuated during the installation of a cable between the actuating lever and the handle of the door because the complementary attachment features are separate from the bolt and the striker wire 11.

The door opening is then closed again on the bodywork of the vehicle with the lock pre-fixed as indicated above. If the lock 20 is prefixed in the lower position of the door opening and if the attachment features of the lock 20 are located in the delta-shaped opening of the housing, the striker 10 does not collide with the floor 100 because the striker support plate 15 is inclined relative to the floor 100 of the vehicle (FIG. 5).

The striker 10 may then be fixed to the vehicle. When the striker support plate 15 is inclined relative to the horizontal once the lock 20 is pre-fixed, simple screwing-in of the striker support plate 15 may make it possible to cause the disengagement of the complementary attachment features, namely the removal of the pin 50 from the recess 51 in the example illustrated. There is, therefore, no additional operation for the operator to carry out to detach the striker 10 from the lock 20 once the fixing is complete. Once the striker 10 is fixed to the bodywork, the operator may complete the fixing of the lock 20 on the door opening by providing it with its definitive position.

The closure system according to the invention thus allows the fixing of the system on a vehicle to be simplified. Naturally, the present invention is not limited to the embodiments described by way of example. In particular, the respective positions of the pin 50 and the recess 51 may be exchanged, modified and/or duplicated. For example, a pin or a recess may be located on a face of the lock housing, and a recess or pin may be arranged on a tongue of the striker support plate 15 to cooperate with the pin or the recess of the housing. The pin 50 may be made of plastic and may be separate from a possible damping device 14 surrounding the striker wire 11. It may also be made of metal and penetrate a flexible recess, for example made of rubber.

Moreover, although the invention has been described by making reference to doors of utility vehicles, it is understood that the closure system according to the invention is perfectly applicable to doors of passenger vehicles. Moreover, the retention between the striker 10 and the lock 20 may be carried out by any features other than a pin and a recess as long as the coupling of the striker 10 to the lock 20 remains easy, and the striker 10 is detached from the lock 20 without particular force when the striker support plate 15 is screwed in. The attachment feature other than the pin and the recess illustrated may be, for example, magnetic zones or a clip which is broken when the striker plate is screwed in.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A closure system for a vehicle door opening, the closure system comprising:

a striker including a support plate and a striker wire; and a lock including a bolt actuated by a detent pawl and adapted to retain the striker wire, wherein the lock has a first attachment feature separate from the bolt that is configured to releaseably engage a complimentary second attachment feature of the striker, the second attachment feature being separate from the striker wire, and wherein the first attachment feature and the second attachment feature are configured to secure the striker to the lock regardless of a position of the bolt when the lock and the striker are in a pre-installation configuration, and wherein the first attachment feature and the second attachment feature are configured to no longer engage each other when the striker and the lock are in an installed configuration, wherein the striker is fixed to a vehicle bodywork proximate to a vehicle door opening and the lock is fixed to a vehicle door when the striker and the lock are in the installed configuration.

2. The closure system for a vehicle door opening according to claim 1, wherein the first attachment feature is a pin and the second attachment feature is a recess adapted to retain the pin.

3. The closure system for a vehicle door opening according to claim 1, wherein the first attachment feature and the second attachment feature are configured to secure the striker to the lock regardless of a position of the detent pawl of the lock.

4. The closure system for a vehicle door opening according to claim 1, wherein the lock includes a lock housing provided with an opening adapted to receive the striker wire, the opening of the lock housing including a delta-shaped portion, the first attachment feature of the lock being located on the delta-shaped portion of the lock housing.

5. The closure system for a vehicle door opening according to claim 4, wherein the striker includes a stop in abutment in the opening of the lock housing when the striker wire is retained by the bolt, the stop extending over a portion of the support plate.

6. The closure system for a vehicle door opening according to claim 5, wherein the second attachment feature of the striker is formed in the stop.

7. The closure system for a vehicle door opening according to claim 1, wherein the lock includes a retaining plate, and the support plate has a non-zero angle $\beta$ of inclination with a plane perpendicular to a plane of the retaining plate that contains the striker wire when the first attachment feature and the second attachment feature cooperate.

8. The closure system for a vehicle door opening according to claim 7, wherein the retaining plate of the lock has at least one oblong fixing hole, and the non-zero angle of inclination of the support plate is such that $L \cdot \sin(\beta) > \Delta s$, wherein L is a length of the support plate perpendicular to the retaining plate of the lock, $\Delta s$ is a length of the at least one oblong fixing hole less a width of the at least one oblong fixing hole.

9. The closure system for a vehicle door opening according to claim 1, including a damping device surrounding a portion of the striker wire and extending over a portion of the support plate.

10. The closure system for a vehicle door opening according to claim 9, wherein the second attachment feature is formed in the damping device.

11. The closure system for the vehicle door opening according to claim 1, wherein the first attachment feature is a plastic pin and the second attachment feature is a recess adapted to retain the pin.

12. A lock for closing a door opening, the lock comprising:

a bolt adapted to retain a striker wire of a striker;

a retaining plate;

a housing having an opening with at least one delta-shaped portion; and at least one first attachment feature formed inside the opening in the at least one delta-shaped portion, the at least first one attachment feature being configured to releasably engage at least one second attachment feature of the striker regardless of the position of the bolt when the lock and the striker are in a pre-installation configuration, and wherein the at least one first attachment feature and the at least one second attachment feature are configured to no longer engage each other when the striker and the lock are in an installed configuration, wherein the striker is fixed to a vehicle bodywork proximate to a vehicle door opening and the lock is fixed to a vehicle door when the striker and the lock are in the installed configuration.

13. The lock according to claim 12, wherein the retaining plate has at least one oblong fixing hole, the at least one delta-shaped portion of the opening of the housing is at an angle ($\gamma$) with a plane perpendicular to a plane of the retaining plate, and the angle of the at least one delta-shaped portion is such that $D \cdot \sin(\gamma) > \Delta s$, wherein D is a length of the at least one delta-shaped portion and $\Delta s$ is a length of the at least one oblong fixing hole less a width of the at least one oblong fixing hole.

14. The lock as in claim 12, wherein the at least first one attachment feature is a plastic pin and the at least second one attachment feature is a recess adapted to retain the pin.

15. A method for installing a closure system for a door opening on a vehicle, the method comprising the steps of:

pre-fixing a lock on a vehicle door wherein the lock further comprises a bolt adapted to retain a striker wire of a striker removably secured to the lock by a first attachment feature disposed on the lock and a second attachment feature disposed on the striker, the first attachment feature being configured to engage the second attachment feature when the lock and the striker are in a pre-installed configuration, wherein the first attachment feature engages the second attachment feature regardless of the position of the bolt of the lock when the lock is in the pre-installed configuration; and disengaging the first attachment feature from the second attachment feature by fixing the striker to a vehicle bodywork to cause the lock and the striker to be in an installed configuration, wherein the first attachment feature and the second attachment feature do not engage each other when the lock and the striker are in the installed configuration, wherein the striker is fixed to a vehicle bodywork proximate to a vehicle door opening and the lock is fixed to the vehicle door when the striker and the lock are in the installed configuration.

16. The method according to claim 15, wherein the striker includes a support plate.

17. The method according to claim 16, including a damping device surrounding a portion of the striker wire of the striker and extending over a portion of the support plate.

18. The method according to claim 17, wherein the second attachment feature is formed in the damping device.

19. The closure system for a vehicle door opening according to claim 15, wherein the first attachment feature is a plastic pin and the second attachment feature is a recess adapted to retain the plastic pin.

* * * * *